US005713981A

United States Patent [19]

Amick

[11] Patent Number: 5,713,981

[45] Date of Patent: Feb. 3, 1998

[54] COMPOSITE SHOT

[75] Inventor: Darryl Dean Amick, Albany, Oreg.

[73] Assignee: Teledyne Industries, Inc., Albany, Oreg.

[21] Appl. No.: 474,890

[22] Filed: Jun. 7, 1995

Related U.S. Application Data

[63] Continuation-in-part of Ser. No. 323,690, Oct. 18, 1994, Pat. No. 5,527,376, which is a continuation-in-part of Ser. No. 130,722, Oct. 4, 1993, abandoned, which is a division of Ser. No. 878,696, May 5, 1992, Pat. No. 5,264,022.

[51] Int. Cl.[6] ..... B22F 9/08

[52] U.S. Cl. ..... 75/340; 264/13

[58] Field of Search ..... 75/340, 341; 264/13

[56] References Cited

U.S. PATENT DOCUMENTS

| | | | |
|---|---|---|---|
| 1,847,617 | 3/1932 | Lowenstein et al. | 420/431 |
| 2,119,876 | 6/1938 | Corson | 264/13 |
| 2,919,471 | 1/1960 | Hechinger | 75/340 |
| 3,372,021 | 3/1968 | Forbes et al. | 420/431 |
| 3,890,145 | 6/1975 | Hivert et al. | 75/244 |
| 4,035,115 | 7/1977 | Hansen | 418/183 |
| 4,035,116 | 7/1977 | O'Brien et al. | 264/13 |
| 4,274,940 | 6/1981 | Plancqueel et al. | 204/294 |
| 4,383,853 | 5/1983 | Zapffe | 420/3 |
| 4,760,794 | 8/1988 | Allen | 102/473 |
| 4,881,465 | 11/1989 | Hooper et al. | 102/501 |
| 4,897,117 | 1/1990 | Penrice | 75/248 |
| 4,931,252 | 6/1990 | Brunisholz et al. | 419/23 |
| 4,940,404 | 7/1990 | Ammon et al. | 419/28 |
| 4,949,645 | 8/1990 | Hayward et al. | 102/517 |
| 4,960,563 | 10/1990 | Nicolas | 419/23 |
| 4,961,383 | 10/1990 | Fishman et al. | 102/517 |
| 5,069,869 | 12/1991 | Nicolas et al. | 419/28 |
| 5,264,022 | 11/1993 | Haygarth et al. | 420/122 |
| 5,279,787 | 1/1994 | Oltrogge | 419/38 |
| 5,399,187 | 3/1995 | Mravic et al. | 75/228 |

FOREIGN PATENT DOCUMENTS

| | | | |
|---|---|---|---|
| 521944 | 2/1956 | Canada | 264/13 |
| 52-68800 | 6/1977 | Japan | 102/514 |
| 59-6305 | 1/1984 | Japan | 264/13 |
| 1-142002 | 6/1989 | Japan | 420/122 |
| 731237 | 6/1955 | United Kingdom | 75/340 |

OTHER PUBLICATIONS

*American Hunter*, Feb. 1992, pp. 38, 39 and 74.

*Primary Examiner*—George Wyszomierski
*Attorney, Agent, or Firm*—Shoemaker and Mattare,Ltd.

[57] ABSTRACT

High specific gravity, lead free shotshell pellets are produced by preparing an iron-tungsten alloy having a specific gravity of at least 8 g/cc, melting the alloy at a temperature of about 1550°–1760° C., pouring the melted alloy through at least one orifice of a sieve having a specific sized opening so as to produce a desired final product size, and allowing the melted alloy to fall by gravity through a gaseous medium to form drops of molten metal, and cooling the individual molten drops to form spherical metal pellets. A plurality of orifices of different sizes may be used in order to form a desired distribution of shot pellet sizes.

10 Claims, 3 Drawing Sheets

BINARY ALLOY PHASE DIAGRAMS

COMPOSITE SHOT

This application is a continuation-in-part of application Ser. No. 08/323,690, filed Oct. 18, 1994, now U.S. Pat. No. 5,527,376; which is a continuation-in-part of application Ser. No. 08/130,722, filed Oct. 4, 1993, now abandoned; which is a divisional of application Ser. No. 07/878,696, filed May 5, 1992, now U.S. Pat. No. 5,264,022.

FIELD OF THE INVENTION

The present invention relates to metal shot alloys having high specific gravities and to methods for their preparation and to shot shells containing such alloy shot pellets. When compared to lead and lead alloys, these shot and shot shells are substantially non-toxic and favorably comparable in terms of their ballistic performance.

Shotshells containing lead shot pellets in current use have demonstrated highly predictable characteristics particularly when used in plastic walled shot shells with plastic shotcups, or wads. These characteristics include uniform pattern densities with a wide variety of shotgun chokes and barrel lengths, and uniform muzzle velocities with various commercially available smokeless powders. All of these characteristics contribute to lead shot's efficacy on game, particularly upland game and bird hunting. This characteristic predictability has also enabled the user to confidently select appropriate shot sizes and loads for his or her own equipment for hunting or target shooting conditions. Steel shot currently does not offer the same predictability. Each hunting season is prefaced with new commercial offerings of ammunitions to ameliorate one or more of the disadvantages associated with the use of steel shot which disadvantages include lower down-range velocities, poor pattern density and lower energy per pellet delivered to the target. Most, if not all, of these disadvantages could be overcome by the use of shot shell pellets which approximated the specific gravity of the lead or lead alloy pellets previously employed in most shot shell applications. With the increased concern for the perceived adverse environmental impact resulting from the use of lead containing pellets in shotgun shot shells there has been a need for finding a suitable substitute for the use of lead that addresses both the environmental concerns surrounding the use of lead while retaining the predictable behavior of lead in hunting and target shooting applications.

The currently approved pellet material for hunting migratory water fowl is steel. Steel shot pellets generally have a specific gravity of about 7.5 to 8.0, while lead and lead alloy pellets have a specific gravity of about 10 to 11. This produces an effective predictable muzzle velocity for various barrel lengths and provides a uniform pattern at preselected test distances. These are important criteria for both target shooting such as sporting clays, trap and skeet as well as upland game and bird hunting. Conversely, steel shot pellets do not deform; require thicker high-density polyethylene wad material and may not produce uniform pattern densities, particularly in the larger pellet sizes. This has necessitated the production of shot shells having two or more pellet sizes to produce better pattern densities. Unfortunately, the smaller pellet sizes, while providing better patterns, do not deliver as much energy as do the larger pellets under the same powder load conditions. Also the lower muzzle velocities requires the shooter to compensate by using different leads on targets and game.

Further, the dynamics of the shot pellets are significantly affected by pellet hardness, density and shape, and it is important in finding a suitable substitute for lead pellets to consider the interaction of all those factors. However, the pattern density and shot velocity of lead shot critical for on-target accuracy and efficacy have thus far been very difficult to duplicate in environmentally non-toxic substitutes.

It has been appreciated that high density shot pellets, i.e., shot material having a specific gravity greater than about 8 gm/cm$^3$ is needed to achieve an effective range for shotshell pellets. Various methods and compositions that have been employed in fabricating non-lead shot have not yet proven to be satisfactory for all applications. While various alternatives to lead shot have been tried, including tungsten powder imbedded in a resin matrix, drawbacks have been encountered. For example, even though tungsten metal alone has a high specific gravity, it is difficult to fabricate into shot by simple mechanical forming and its high melting point makes it impossible to fabricate into pellets using conventional shot tower techniques. The attempts to incorporate tungsten powder into a resin matrix for use as shot pellets has been attempted to overcome some of these drawbacks. The February 1992 issue of *American Hunter*, pp. 38–39 and 74 describes the shortcomings of the tungsten-resin shot pellets along with tests which describe fracturing of the pellets and a loss of both shot velocity and energy giving rise to spread out patterns. Particularly, in the smaller shot size, the tungsten-resin shot was too brittle, lacking needed elasticity and, therefore, fractured easily.

Cold compaction of other metals selected for their higher specific gravity has resulted in higher density shot pellets having an acceptable energy and muzzle velocity, such as described in U.S. Pat. No. 4,035,115, but the inventions described therein still involve the use of unwanted lead as a shot component.

Still other efforts toward substitution of other materials for lead in shot have been directed to use of steel and nickel combinations and the like, particularly because their specific gravities, while considerably less than lead, is greater than the 7–8 range typical of most ferrous metals. Some of these efforts are described in U.S. Pat. Nos. 4,274,940 and 4,383,853.

Still other high density metals such as bismuth and combinations of iron, in combination with tungsten and nickel have also been suggested as lead shot substitutes. However, iron has a melting point of about 1535° C.; nickel about 1455° C. and tungsten about 3380° C. thus creating shot fabrication difficulties. None of the suggested lead substitutes except Bismuth achieve the advantageous low melting point of lead i.e. 327° C., requiring only minimal energy and cost-effectiveness in the manufacture of lead shot.

Ballistic performance equal to or superior to that of lead would be offered by a material having a specific gravity equal to or greater than that of lead.

OBJECTS OF THE INVENTION

One object of the present invention is to provide a suitable non-toxic substitute for lead shot.

Another object of this invention is to use relatively high specific gravity tungsten-containing metal alloys as small arms projectiles and shot pellets for use in shot shells, which are cost effective to produce and which can perform ballistically, substantially as well as lead and lead alloys or better, without the need to fabricate from the molten state.

Another object of this invention is to provide improved processes and products made thereby, including small arms projectiles and shot made from a range of tungsten-iron alloys, or of shot pellets of tungsten alloys or mixtures of alloys having pre-selected specific gravity characteristics.

These and other objects and advantages of the present invention are achieved as more fully described hereafter.

BRIEF SUMMARY OF THE INVENTION

It has been found that steel/tungsten (Fe/W) based alloys, such as those containing from up to about 46% or greater by weight and more preferably from about 30% to about 46% by weight of tungsten demonstrate not only a lower melting point than the melting point of tungsten, but also exhibit properties which make them particularly useful in some shot fabrication processes. The steel-tungsten alloys of the present invention, when formed into spherical particles of preselected shot diameters, are superior to currently available steel shot and can exhibit ballistic and other properties which can be comparable to conventional lead shot.

Additionally, alloys of the same or higher tungsten content, although fusible, are more easily brought to useful shape by the techniques of powder metallurgy. In contrast to the iron-tungsten system, in which interaction between the metals lowers the liquidus temperature below that of pure tungsten, in some systems, such as tungsten-copper, there is little interaction, and the liquidus is not lowered by addition of the second metal. For these systems, powder metallurgy is ideally suited to the mass-production of small parts to precisely-controlled shape and dimensions. According to the present invention, it is possible to produce spheres of diameter as small as 0.070" or smaller, and up to 1" or more if desired. For use as shot, these spheres optionally may be plated with copper or zinc, or coated with lubricant such as molybdenum disulfide, graphite, or hexagonal boron nitride, if desired, for specific functional characteristics.

BRIEF DESCRIPTIONS OF THE DRAWINGS

DETAILED DESCRIPTION OF THE INVENTION

Figure 1:
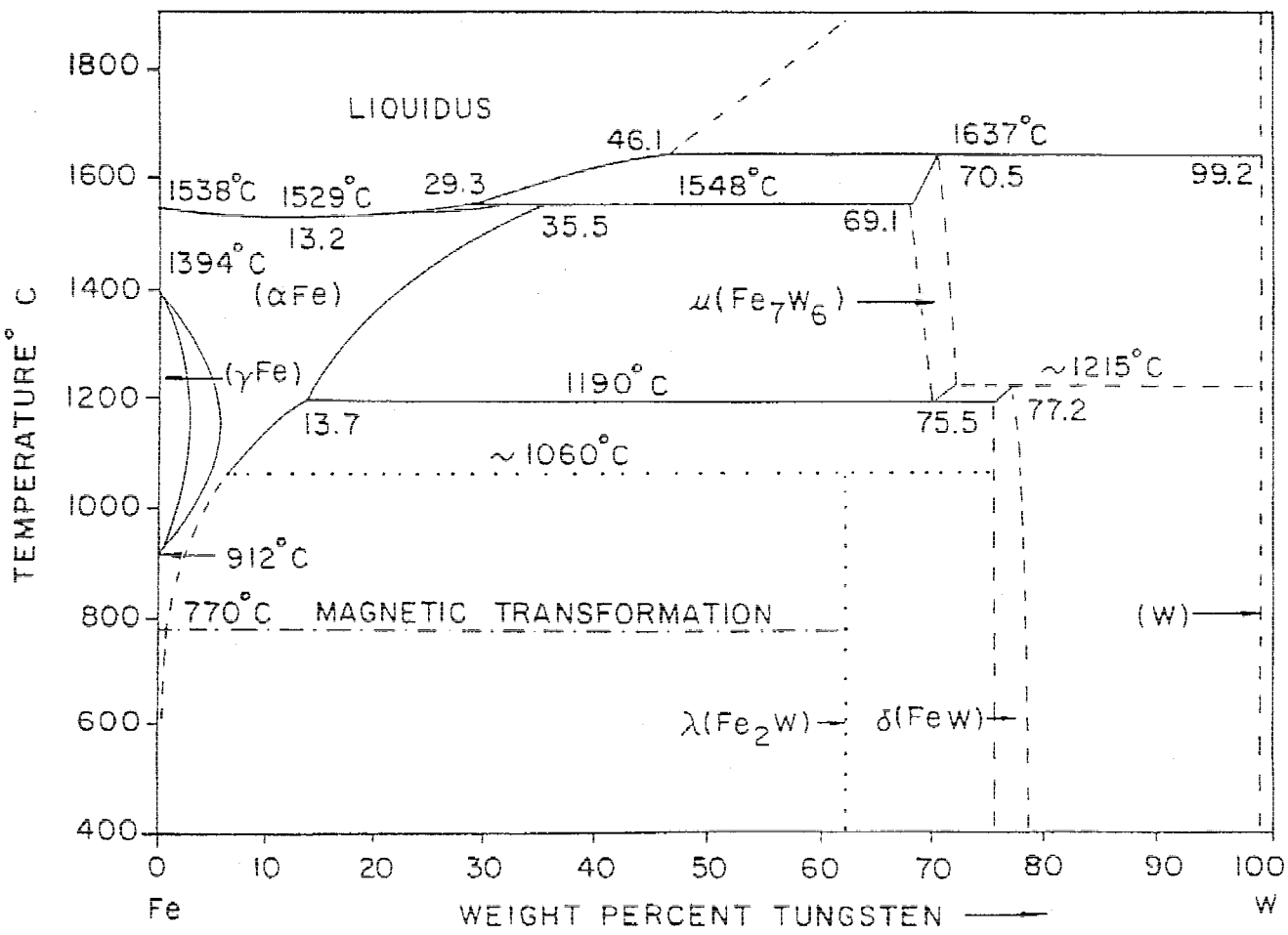
FIG. 1 is a phase diagram of the Fe/W alloys used herein.

Steel-tungsten alloys, containing from about 30% to about 85% by weight of tungsten and preferably from about 30% to about 70% by weight of tungsten can be formed into pellets suitable for use in shot shells by fabrication from the molten state or by powder metallurgical processes. These pellets can have specific gravities in the range of from about 8 to above 12. The pellets when formed from the molten state are prepared by a process consisting essentially of heating the binary alloy of steel-tungsten to a temperature about 1548° C., then increasing to not less than about 1637° C. at which temperature the alloy evolves into a liquids phase when the tungsten is present in an amount of up to about 46.1%. The heated liquid alloy is then passed through refractory sieves having holes of a sufficient diameter, spaced appropriate distances apart to obtain the desired shot size, or quenched under specific conditions described hereinafter. Unwanted high viscosity is avoided by controlling molten alloy temperature and the resulting sieved alloy falls about 12 inches to about 30 inches, through air, argon, nitrogen or other suitable gas into a liquid such as water at ambient temperature, causing the cooled shot to form into spheres of desired sizes. Though generally of the desired shape, they can be further smoothed and made more uniform by mechanical methods such as grinding, rolling, or coining.

EXAMPLE 1

Shot or pellet types of the present invention having different sizes are obtained by first melting the Fe/W alloys.

A 200-g vacuum-arc melted button was prepared from 0.18% carbon steel turnings an W powder ($C_{10}$ grade). The dissolution of the W was both rapid and complete as indicated by a metallographic section. The alloy was predetermined to be 60 wt % Fe/40 wt % W having a calculated density of 10.3 g/cm. This compared favorably to its actual density measured at 10.46 g/cm$^3$. Conventional lead shot is 97 Pb/3 Sb or 95 Pb/5 Sb which has a density of 11.1 gm/cm$^3$ or 10.9 gm/cm$^3$, respectively.

A larger quantity of the above alloy was melted and poured through porcelain sieves of various hole sizes and spacings, then allowed to fall through a distance of air and ambient temperature water to produce about 3.1 pounds of shot.

Molten alloy at 3000°–3100° F. was poured into a "water glass"-bonded olivine funnel containing a porcelain ceramic sieve and suspended 12" above a 6" I.D. Pyrex column containing 60" of 70° F. water. The column terminated at a Pyrex nozzle equipped with a valve through which product could be flushed into a bucket. The porcelain ceramic sieve (part number FC-166 by Hamilton Porcelains, Ltd. of Brantford, Ontario, Canada) had been modified by plugging 58% of the holes with castable refractory to obtain a pattern of holes 0.080" dia. separated by spacings of approximately 0.200". Although an oxyacetylene torch was used to preheat the funnel/sieve assembly, a melt temperature of 1685° C. resulted in very little flow through the sieve because of rapid radiative heat loss in the need for transporting molten metal from furnace-to-ladle-to-funnel in the experimental set-up employed. Increasing the melt temperature to 1745° C. resulted in rapid flow through the sieve for approximately 15 seconds, resulting in the product described in Table 1 in terms of the particle size in contrast to the shape.

TABLE 1

Size Distribution

| Size, in. | Wt., lb. | Wt % |
|---|---|---|
| −½ +¼ | 1.90 | 62.1 |
| −¼ +0.157 | 0.85 | 27.8 |
| −0.157 +0.055 | 0.30 | 9.8 |
| −0.055 | 0.01 | 0.3 |
| | 3.06 | 100.0 |

A sample of the −0.157"/+0.055" fraction was mounted polished, and etched to reveal microstructural details and microporosity.

It was found that Fe/W alloy is particularly effective in forming relatively round, homogeneous diameter particles of ≦0.25" which become spherical in a free fall through about 12" of air, then through about 60" of water at ambient temperature (70° F.).

It is believed that the pellet diameter is not strictly a function of the sieve hole diameter because droplets of spherical shape grow in diameter until a "drip-off" size is achieved. In addition, if the viscosity of the melted alloy is too low, multiple streams of metal will flow together forming a liquid ligament.

This desired viscosity can be controlled by adjusting the temperature of the molten alloy to achieve the desired shot formation. That is, avoiding merging streams and tear drop shapes. This can be accomplished without undue experimentation with the specific equipment or apparatus sued by maintaining its temperature high enough so that at the point where the liquid metal enters the sieve its surface tension will cause the formation of spherical droplets from the sieve.

By controlling the alloy melt temperature to about 1645° C. to about 1760° C. and the sieving temperature to a temperature above about 1550° C.", so-called ligaments or elongated shot are avoided as well as other anomalous sizes and shapes caused by unwanted high viscosity.

The present invention overcomes many of the disadvantages of steel shot previously described, including less than desirable pattern density. Even though various pellet sizes can be used for steel shot shells, because the specific gravity of Fe is 7.86, its ballistic performance results for any given size is characterized by decreased force or energy, compared to lead and lead alloys.

In overcoming this, the present invention includes cartridges of multiple shot sizes such as the so-called duplex or triplex combinations of different pellet sizes presently commercially available, which are said to increase the pattern density of the pellets delivered to a test target. By preselecting a particular distribution of shot sizes, i.e., diameters, and the proportion of the different sizes of pellets within the cartridge, an appropriate or desired pattern density can be achieved with a high degree of accuracy and effectiveness.

In addition, the pellet charge of the present invention consist of various sized shot and include mixtures of both high and low specific gravity alloy pellets of different diameters.

Heretofore, lead shot provided the standard against which accuracy was measured generally using only one size pellet. Lead-free shot pellets made of the Fe/W alloys of the present invention possess advantages both over toxic lead pellets and other metals substituted as replacements. This is particularly so because the different specific gravities in the mixture of shot pellets sizes, easily produced by the processes disclosed herein, provide a superior pattern density and relatively uniform delivered energy per pellet.

By providing a predetermined pellet mix of two (duplex) or three (triplex) or more pellet combinations of varying diameters and varying densities or specific gravities, both the pattern density over the distance between discharge and on the target and the depth of impact of the smaller shot is improved. The energy of the shot combination is improved because there is little shot deviation on firing. The increased drag forces (per unit volume) encountered by a relatively smaller particle at a given velocity in air may be offset by constructing such a particle from alloy of a relatively higher specific gravity. The larger diameter steel shot on the other hand with a larger diameter and less specific gravity if correlated as described hereinafter to the smaller size Fe/W shot.

Appropriate selection of shot sizes and the specific gravity of the alloys used for the various shot sizes can provide for the same energy delivered by each size to a preselected target. This can most graphically be demonstrated by the gelatin block test, etc. This will provide a significant improvement over the present use of steel pellets of the same specific gravity and different diameters used in the so-called "duplex" and "triplex" products. Because their diameters differ, shot pellets of the same specific gravity will exhibit different ballistic patterns.

By determining the drag force of spheres, such as round shot pellets, traveling through a fluid, such as air, the drag forces of different metals having different radii and specific gravities can be determined.

$$\text{Drag Force} = (\pi R^2)\frac{(\rho V^2)}{2} f$$

where R=radius, ρ=density or specific gravity, V=velocity and f=friction factor (a function of several variables including Reynolds number, roughness, etc.).

The drag forces per unit volume for both steel shot and FeW shot are determined and equated according to the following $$\frac{R_1}{R_2} = \sqrt{\frac{\rho_1}{\rho_2}}$$

where $R_1$, $\rho_1$ refer to steel and $R_2$, $\rho_2$ refer to FeW alloy containing 40 wt. % W, then $$R_1 = R_2\sqrt{\frac{10.3}{7.86}} \text{ or } R_1 = R_2 \times 1.15$$

By this method, the following mixes (duplex) of two pellet sizes and compositions are obtained, and presented as examples.

| Mixture | Steel Shot Sizes | Iron-40% Tungsten Shot Sizes |
|---|---|---|
| #1 | #6 (0.11" dia.) | #7½ (0.095" dia.) |
| #2 | #4 (0.13" dia.) | #6 (.11" dia.) |
| #3 | #2 (0.15" dia.) | #4 (.13" dia.) |
| #4 | BB (0.18" dia.) | #2 (.15" dia.) |

It is contemplated that various other specific methods of melting various material configurations of iron and tungsten together or separately and then mixed, can successfully be employed in the practice of the present invention.

Further, improvements in the ballistic performance rust prevention and abrasiveness to steel barrels can be achieved by coating the pellets of the present invention with a suitable layer of lubricant or polymeric or resinous material or surface layer of a softer metal. The mixed shotshell pellets where steel alone is the material of choice for one or more of the pellet sizes may also advantageously be coated as described herein to improve resistance to oxidation. The covering or coating can be of any suitable synthetic plastic or resinous material softer metal layer, that will form an oxidation resistant or lubricant film which adheres to the pellets. Preferably, the coating should provide a non-sticking surface to other similarly coated pellets, and be capable of providing resistance to abrasion of the pellet against the steel barrel. Typically suitable materials can be selected from petroleum based lubricants, synthetic lubricants, nylon, teflon, polyvinyl compounds, polyethylene polypropylene, and derivatives and blends thereof as well as any of a wide variety of elastomeric polymers including ABS polymers, natural and synthetic resins and the like. Coatings may be applied by methods suitable to the materials selected which could include hot melt application, emulsion polymerization, solvent evaporation or any other suitable technique that provides a substantially uniform coating that adheres well and exhibits the previously described characteristics. The application of a metal layer will be more fully described hereinafter particularly with respect to pellets formed by powder metallurgical processes.

In addition, the shot shells of the present invention can employ buffering materials to fit either interstitially with the shot charge or not, depending on the performance parameters sought. Granules of polyolefins or polystyrene or polyurethane or other expanded or solid materials can be utilized and some have been employed in conventional lead and lead alloy and steel shot charges in shot shells. Such buffering with or without shot coatings may advantageously be employed to add dampening and shot and barrel lubrication properties. The shot shells of the present invention can be fabricated with or without conventional shotcup wads.

In the preferred practice of the present invention, it has been found that it is possible to fabricate the articles described herein in to the desired shapes by pressing metal or alloy powder or a mixture of the metal or alloy powders, with or without a binder or lubricant, optionally treating to remove surface imperfections resulting from the pressing, then sintering at elevated temperature in vacuum, or in hydrogen, nitrogen, or in an inert gas such as argon for a period of ranging from minutes to several hours, with or without a prior separate step to remove the binder or lubricant, then if necessary grinding to final size and to final shape to produce the aforementioned projectiles or parts thereof.

The compositions of the alloys from which the projectiles are made are based on binary alloys of tungsten with iron, with other suitable metals preferably copper, to which minority components may be added with advantage.

Powders from which the to-be-sintered pressings are made may be produced by comminution then mixing of alloys prepared from alloys different from the desired composition, by mixing an elemental end-member in powder form with a powder prepared from an alloy different from the desired composition, or by mixing of elemental powders. Such powders may be used without additives, or may contain up to several parts per hundred by weight of binders and lubricants such as paraffin wax, and/or of fluxes. In particular, powders from which the pressings are made may be prepared from mixtures of powders prepared by comminution of ferrotungsten alloys of various composition, with, if necessary, admixture of iron powder or tungsten powder or of a powder of ferrotungsten alloy of a different composition, so that the desired powder composition might be achieved. Likewise, tungsten-aluminum alloy powders of desired composition may be made by comminution of tungsten-aluminum alloys, or the desired powder composition may be obtained by mixture of appropriate tungsten-aluminum alloy powders of different compositions. Tungsten-copper powders may be made for example, by mixing elemental powders or by co-reducing mixtures of tungsten oxide and copper oxide with hydrogen, or by depositing copper on tungsten powder by electrolytic reduction or by an electroless coating process. Tungsten-copper powders advantageously may contain additions such as nickel or iron. Tungsten-iron powders may advantageously contain nickel and/or silicon at the level of a few percent.

It will be appreciated by those skilled in the art, that whereas articles comprised predominately of iron and tungsten, prepared from alloys in the molten state, or from powders sintered at high temperatures will have at least part, and in some cases all, of their tungsten attribute present as intermetallic compounds such as $WFe_2$ and $W_6Fe_7$. Articles prepared by sintering at lower temperatures of powder mixtures in which the tungsten attribute is present as elemental tungsten will have most, and in some cases all, of their tungsten attribute present as elemental tungsten. Both materials containing tungsten partly or totally present as the element, are capable of exhibiting useful values of density and of other mechanical properties, and are included among materials of interest for fabrication of shot and other small-arms projectiles.

Powders, including those prepared as described hereinbefore, may be pressed to shape as mixed or may be agglomerated, or pre-compacted and granulated, in a variety of ways familiar to those skilled in the art, prior to pressing to shape.

Shapes such as spheres, and other shapes of interest in the production of projectiles or of projectile parts, may be prepared by compaction of any of the described powders. This pressing may be done in any of a variety of commercially available machines, such as the Stokes DD-S2, a 23 station, 15-ton rotary press, or the Stokes D-S3, a 15-station, 10-ton rotary press, both of which can be equipped with shaped punches and insert dies suitable for production of the shapes desired. Such machines may be adjusted to deliver the pressing force and the duration of the pressing force required for the part to be produced.

If desired, the pressed parts may be treated before sintering to remove surface imperfections. For example, the equatorial "belt" on space out on pressed balls seen in FIGS. 2 and 3 may be removed by shaking the pressings on a sieve screen or other rough surface. The pressed parts may be optionally exposed to a treatment, usually combining reduced pressure and increased temperature, for removal of the binder prior to sintering. Frequently though, this step is combined with the sintering step. Sintering may be conducted at temperatures of 1000° C. or lower to 1600° C. or higher, for less than one hour to more than eight hours, either batch-wise or continuously, with slow or rapid heating and/or cooling, in vacuum, in a hydrogen atmosphere or a nitrogen atmosphere or in any of several inert gas atmospheres such as helium or argon. After sintering, if necessary, the parts may be submitted to a grinding process, or may be tumbled in a mill, or honed in a vibro-hone to remove undesirable surface features. In the case of spheres, the "belt" acquired during some types of pressing operations may be removed using machines such as the Cincinnati Bearing Grind or the Vertisphere 1⁹⁄₂₄ ball-lapping machine, to produce smooth spherical parts. Optionally after these operations, the parts may be cleaned, then coated, plated, and/or provided with lubricant.

Specific examples of the powder metallurgical process for production of shot from mixtures of iron and tungsten powders or from mixtures of iron powder and tungsten-iron alloy powders are described hereinafter. These are exemplary only, and are not intended to be exclusive. Indeed, the extension to other shapes, and to the other alloy systems mentioned, will be clearly apparent to those skilled in the art.

EXAMPLE 2

Figure 3:
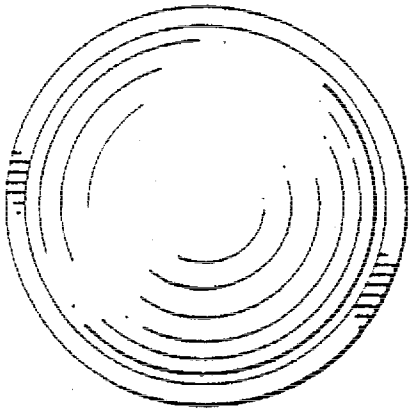
FIG. 3 is an end view of the pellet of FIG. 2.
Figure 2:
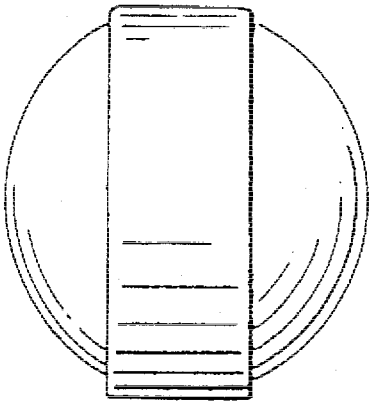
FIG. 2 is a plane view of a pellet made according to one embodiment of the present invention.

Tungsten powder, 9 lb, grade C-5, 1.3 μm median particle size from Teledyne Advanced Materials, was mixed with iron powder, 6 lb either grade R-1430 from International Specialty Products (ISP), Huntsville, Ala., or grade CM from BASF of Parsippany, N.J., to give a mixture containing 60 mass % W and 40 mass % Fe. To this was added 0.15 lb Acrawax C lubricant from Glyco, Inc., and the whole, of mass 15.15 lb, was placed in a 0.5 cu. ft. V-cone blender, which was then sealed and rotated at 0.5 rpm for 120 min. A similar batch was prepared, identically, using iron powder. The mixture was then used to prepare a quantity of belted spherical pellets, of diameter 0.197" as shown in FIGS. 2 and 3, using a Stokes DD-52, 23 station, 15-ton rotary press, equipped with appropriate dies and punches. The pellets were subjected to a treatment to remove the Acrawax lubricant, consisting of heating to 400° C. in a vacuum of 50 micron of mercury or better, and maintaining these conditions for three hours. In commercial practice, this could be done in the sintering furnace as the first stage of the sintering process. Pellets so produced were then placed in an electric furnace equipped with molybdenum elements, and sintered in flowing hydrogen at one atmosphere pressure by heating at 1000° C./hr to either 1450° C. or 1500° C., which temperature was held for one hour, after which the furnace was turned off and allowed to cool to room temperature. Sintering temperatures, densities, crushing-strengths and other data for the pellets so obtained are given in Table 2 as runs 1 through 6.

TABLE 2

SINTERING TEMPERATURES, COMPOSITIONS, AND SOME PROPERTIES OF SOME TUNGSTEN-IRON AND TUNGSTEN-COPPER SHOT PREPARATION

| Run No. | Example No. | Composition mass % | Iron Powder type | Sintering Temp., °C. | Density, meas., gm/cc | Density, calc, g/u | Crushing Strength psi |
|---|---|---|---|---|---|---|---|
| 1 | 2 | 60W, 40Fe | ISP | 1450 | 9.93 | 12.20 | 680 ± 160 |
| 2 | 2 | 60W, 40Fe | ISP | 1500 | 11.90 | 12.20 | 550 ± 30 |
| 3 | 2 | 60W, 40Fe | BASF | 1450 | 9.52 | 12.20 | 690 ± 150 |
| 4* | 2 | 60W, 40Fe | BASF | 1500 | 11.75 | 12.20 | 890 ± 30 |
| 5 | 3 | 60W, 40Fe | ISP | 1450 | 8.26 | 12.20 | 560 ± 30 |
| 6 | 3 | 60W, 40Fe | ISP | 1500 | 10.91 | 12.20 | 760 ± 20 |
| 7 | 3 | 60W, 40Fe | BASF | 1450 | 8.00 | 12.20 | 430 ± 20 |
| 8 | 3 | 60W, 40Fe | BASF | 1500 | 9.21 | 12.20 | 580 ± 40 |
| 9 | 4 | 45W, 55Fe | BASF | 1450 | 10.76 | 10.72 | 1370 ± 60 |
| 10 | 4 | 45W, 55Fe | BASF | 1500 | 10.88 | 10.72 | 1400 ± 34 |
| 11 | 4 | 55W, 45Fe | BASF | 1450 | 11.33 | 11.66 | 1200 ± 20 |
| 12 | 4 | 55W, 45Fe | BASF | 1500 | 11.60 | 11.66 | 1260 ± 150 |
| 13* | 5 | 50W, 50Fe | ISP | 950 | 8.7 | 11.17 | — |
| 14 | 6 | 62.6W, 37.4Fe | ISP | 1550 | 11.67 | 12.50 | 672 ± 75 |
| 15 | 7 | 48W, 52Cu | — | 1160 | 11.00 | 12.04 | — |

*Phases present in sintered pellets:
Run 4 $Fe_2W$, $W_6Fe_7$ and W; no Fe detected.
Run 13 α Fe and W; no $W_6Fe_7$ or $Fe_2W$ detected.

EXAMPLE 3

Tungsten powder, 9 lb, grade M-30, 2.1 μm median particle size, from Sylvania, was mixed with 6 lb grade of either ISP R-1430 iron powder or BASF grade CM iron powder and 0.15 lb Acrawax lubricant added. A similar batch was prepared, identically, using iron powder. The mixture was blended, pressed, heated to remove the Acrawax, and sintered as described in Example 1. Resulting temperatures and crushing loads are given in Table 2 as runs 7–12.

EXAMPLE 4

Tungsten powder, Grade C-6, from Teledyne Advanced Materials, was mixed with carbonyl iron powder grade CM from BASF. Two lots were prepared, one containing 45 mass tungsten and the other, 55 mass % tungsten. Each mixture was blended in a Patterson-Kelley V-cone blender fitted with an intensifier-bar until the temperature of the blender shell reached 180° F., whereupon molten paraffin wax, in amount 2 weight % of the mixed powders was added, and blending continued for two hours. The mixtures were granulated by hydrostatically compacting at 27,000 psi followed by crushing and screening to pass 20 mesh but to be retained on 46 mesh. These powders were pressed to form pellets, treated to remove the paraffin wax lubricant, and sintered all as in Example 2, whereupon the densities and crushing strengths were measured. Details are given in Table 3, as runs 9, 10, 11, and 12.

TABLE 3

SHOT PENETRATION TESTS

| Shot type | Size | Mass, gm | Density gm/cc | ¼" Plywood-Penetration | Deformation | Pattern Full Chokes 40 yards, 30" circle |
|---|---|---|---|---|---|---|
| W—Fe Unground | .197 | 0.65 | 9.8 | 4 ⅓ sheets- 1–66, 2–66, 3–65, 4–61, 5–24 | Broke 3 of 66 pellets recovered | N/A |
| Lead BB | .180 | — | 11.1 | 2 ½ sheets- 1–45, 2–42, | Severe (all pellets) | 80% (manufacturerer's claim) |

TABLE 3-continued

SHOT PENETRATION TESTS

| Shot type | Size | Mass, gm | Density gm/cc | ¼" Plywood-Penetration | Deformation | Pattern Full Chokes 40 yards, 30" circle |
|---|---|---|---|---|---|---|
| Steel BB | .180 | 0.39 | — | 3–32 2 ½ sheets- 1–51, 2–45, 3–39 | Moderate-heavy 0.12" dia. flats on recovered pellets | N/A |
| Steel T | .200 | 0.54 | — | 2 ¼- 1–38, 2–33, 3–31 | Moderate 0.6" diam. flats on recovered pellets | N/A |
| W—Fe Ground BB Spherical | .180 | 0.51 | 10.0 | 4 ⅛- 1–62, 2–56, 3–57, 4–53, 5–16 | None | 88% |
| W—FE Unground | .115 | | 11.04 | −1.3 depth of 1st sheet (0.08 inch) | None | N/A |

EXAMPLE 5

Figure 5:
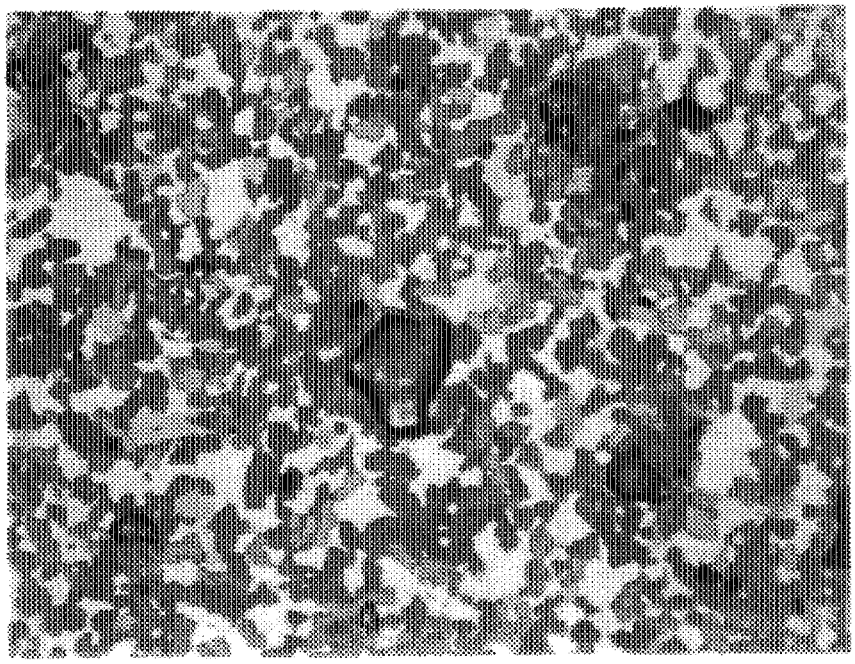
FIG. 5 is a photomicrograph of another embodiment of the present invention.

Tungsten powder, 1 lb, grade C-10 from Teledyne Wah Chang Huntsville was mixed with iron powder, 1 lb, grade R-1430 from ISP, and Acrawax C lubricant, 0.02 lb, added. The ingredients were mixed as in Example 2, pressed to form pellets, and dewaxed and sintered in flowing nitrogen by introducing the boat containing the pellets into the furnace hot zone so that the temperature rose to 950° in 15 minutes, then removing it to a cold zone after a further 30 minutes had elapsed. Density, and crushing-strength data as well as phases present are given in Table 3. A photograph of the microstructure of the metallographically prepared cross section of one of the pellets is shown in FIG. 5, in which only iron and tungsten phases can be observed.

EXAMPLE 6

Ferrotungsten powder, 1 lb, −325 mesh, 78.3 weight % tungsten from H. C. Starck, was mixed with iron powder, ISP grade 1430, 0.20 lb to which Acrawax C lubricant, 0.012 lb, had been added. Pellets as shown in FIGS. 2 and 3 were then pressed and subjected to lubricant removal as described in Example 2, then sintered at 1500° C. as described in Example 2. Results are summarized in Table 3 as run 14, Example 6.

EXAMPLE 7

Metco grade 55 copper powder, 140.4 gm, was mixed with 129.6 gm of grade C-10 tungsten powder, median particle size 4–6 microns from Teledyne Advanced Materials, and the mixture blended in a WAB Turbula type T2C, laboratory-scale mixer. No lubricant was used. The mixture was pressed at 3000 psi to make pellets of diameter 0.115" dia., which were placed in an alumina boat. The boat was placed in a silica tube, inside diameter 1", which was installed in a horizontal tube furnace and through which hydrogen was passed at 1 liter/min. The temperature was raised to 1160° C. and held for 2½ hours, then allowed to fall to room temperature by interrupting the power supply to the furnace and opening it. The results are given as Run 14 in Table 1.

These examples, while not inclusive, suffice to show that tungsten-iron, ferrotungsten-iron, and tungsten-copper mixtures may be sintered to produce pellets of size comparable to shot-shell pellets, with densities comparable with those of the lead alloys now in common use, and with strengths that will ensure their integrity during discharge from the shotgun, during flight and on impact with the target. Furthermore, comparison of the photomicrographs (FIG. 4, FIG. 5) of samples from runs 13 and 4, examples 5 and 2, sintered at low and high temperature respectively and of the corresponding X-ray phase identification (Table 2), indicate that while high-temperature sintering results in compound formation, low-temperature sintering yields largely a mixture of elements, with tungsten in an iron matrix.

Shot pellets were subjected to a crushing test by confining them, singly, between two parallel, hard steel plates and applying a force perpendicular to the plates until the pellet crushed. The force in pounds necessary to crush the ball, called the crushing-strength, is given in Table 2. Density was determined from mass and calculated volume and by the Archimedean method, using mercury as the immersion liquid.

Some samples of sintered shot were ground to remove the pressing-belt and finished to 0.180" diameter, using a Cincinnati Bearing Grind machine.

Shot was tested for penetration and patterning efficiency by substituting an equal mass of the experimental iron-tungsten shot for the shot in commercially-loaded 12-bore, 2¾-inch cartridge, which originally held a load of 1⅛ oz. of steel BB shot. The cartridges were shot using a cylinder-bore (i.e., unchoked) barrel. In order to compare the performance of the iron-tungsten shot with that of commercially available shot, cartridges that were factory-loaded with steel BB shot, Steel T-shot, and lead BB shot were also fired. Penetration tests were done using both as-sintered and ground shot at a range of 20 yards, using a series of ¼ inch thick exterior grade fir plywood sheets, placed in a frame to hold them ¼-inch apart, and perpendicular to the trajectory of the shot. One set of plywood sheets was used for each cartridge fired.

After each shot, the number of holes in each penetrated sheet was determined, and the number of pellets embedded in the last sheet was counted. The average depth of penetration into the last sheet was estimated, and the overall penetration given as the sum of the number of sheets penetrated by at least 90% of the shot, plus the fraction of the thickness of the final sheet penetrated by the shot. Thus a penetration of 2¼ means that at least 90% of the shot penetrated the second sheet, and the average penetration of the shot into the third sheet was one-quarter of its thickness, or about 1/16 inch. A sequence of numbers such as 1-51, 2-45, 3-39 means that 51 pellets penetrated the first sheet, 45 the second, and that 39 were embedded in the third.

Data about the performance of the various kinds of shot that were tested are given in Table 3. This table gives many data, including the number of shot which penetrated each plywood sheet, and which were found embedded in the final sheet for each round fired. The table also gives information about the pattern density obtained with a full coke barrel, and quotes comparable data for a commercially-available load.

The data of the table show that the iron-tungsten shot gives much superior penetration to that of either steel or lead of comparable size, as commercially loaded. Further, no damage was observed in the barrels in which the iron-tungsten shot was fired, even though 15 rounds of iron-tungsten shot were fired through the cylinder bore barrel, and ten through the full-coke barrel, which was of stainless steel.

Further, it has been learned that shot can be cast from the alloys described herein under specific conditions, further described hereinafter, that perform suitably as lead shot and steel shot substitutes in shot shells.

Experiments have demonstrated that adding carbon (2.5%) to 60 Fe 40 W alloy caused the molten droplets to shatter into smaller spheres upon impact with water, producing a desirable distribution of shot sizes with average bulk densities of 10.1 g/cm$^3$. Later experiments on Dec. 14, 1994 evaluated different methods of dispersing molten alloy droplets into water for two different alloys: 57.5 Fe 40 W 2.5 C and 51.5 Fe 46 W 2.5 C. Input material was pure W powder and Sorel iron (4.3% C). The densities of the resulting products were 10.0 and 10.2 g/cm$^3$, respectively. Other experiments demonstrated that ferro-tungsten could be readily substituted for pure W and that varying funnel orifice diameter and quench medium (water vs. brine) would be employed to control product size distributions. The presence of internal cracks in the brine-quenched product indicates that this quench medium yields an excessively high cooling rate.

EXAMPLE 8

Using 40% of pure W and 60% Sorel iron (4.3% C), molten alloy was passed through a porcelain sieve with 0.060" dia. holes and allowed to fall in air for about six (6) feet shattered upon impact with the water, producing size distributions of shot typical of that shown in Table 4.

TABLE 4

| SIZE*, mesh | WT., g | WT. % |
|---|---|---|
| +5 | 221.7 | 26.3 |
| −5 | 455.0 | 54.0 |
| +10 | | |
| −10 | 74.6 | 8.9 |
| +14 | | |
| −14 | 74.3 | 8.8 |
| +20 | | |
| −20 | 16.4 | 2.0 |
| TOTAL | 842.0 | 100.0 |

*For reference, mesh size relates to particle diameter in inches as: 5M = 0.157"; 10M = 0.065"; 14M = 0.0555"; 20M = 0.033". Shotgun sizes: #71/2 = 0.095"; #6 = 0.110"; #4 = 0.130"; #2 = 0.150"; BB = 0.180.

It was observed that much of the shot was agglomerated due to incomplete solidification as the shot piled up on itself in the bottom of the bucket. A sample of unagglomerated shot had an average bulk density of 10.12 g/cm$^3$. Actual carbon assay of the product was 2.52=2.55%, very close the calculated assay of 2.58%. It was very difficult to accurately measure pouring temperature, but the estimate was ≈1350° C.

A fixture was devised consisting of a graphite funnel suspended above a steel sleeve which in turn was positioned above a water-quenching tank with a sloped bottom. The steel sleeve was equipped with a "spider" so that molten metal could be "splattered" onto a ceramic pedestal to shatter the stream into droplets contained by the steel sleeve. Using this apparatus with and without the ceramic pedestal, six (6) experiments were conducted to evaluate two different funnel apertures (0.090" and 0.125"). In addition, two experiments (Runs #6 and #8) were run in which molten alloy was poured into a high-velocity water stream ("granulator"). As shown in Table 5, Run #7 is equivalent to Run #1 except for higher W concentration in the former. This was done in an attempt to obtain higher density. In all cases, Sorel iron was alloyed with pure W powder as feed.

TABLE 5

| Run | Fe (lbs) | W (lbs) | Brick | Aperture (in) | Free Fall (in) | Furnace (Temp C.) | Comments |
|---|---|---|---|---|---|---|---|
| 1 | 9.90 | 5.60 | No | (1) 0.125 | 93 | 1513 | 40W |
| 2 | 9.65 | 4.65 | No | (1) 0.090 | 93 | 1532 | 40W |
| 3 | 8.60 | 5.76 | Yes | (1) 0.125 | 79 | 1578 | 40W |
| 4 | 7.30 | 4.90 | Yes | (1) 0.125 | 52 | 1473 | 40W |
| 5 | 8.50 | 5.70 | No | (5 ea) 0.125 | 93 | x | 40W |
| 6 | 8.30 | 5.60 | x | x | x | x | granulator, 40W, hi flow |
| 7 | 8.90 | 7.55 | No | (3 ea) 0.125 | 93 | 1490 | 46W |
| 8 | 9.25 | 6.20 | x | x | x | x | granulator, 40W, lo flow |

Observations made during casting include:

(1) "Spattering" from a ceramic pedestal produced undesirably fine particle sizes.

(2) Granulation by water jet produced non-spherical parties.

(3) Actual casting temperatures were approximately 1325°–1350° C. with furnace-funnel transfer times of 30–60 sec.

Table 6 presents size distributions for all eight experiments obtained by screening through 5-, 6-, 7-, 8 and 10-mesh screens. Most products from Runs 1, 3, 4, 5 and 7 were generally spherical, although +5-mesh fractions again consisted of agglomerated particles, indicating that water depth (≈16") was inadequate. Particles from Run #2 were somewhat "pancake" shaped, whereas "granulated" particles from Runs 6 and 8 were quite "irregular" in shape.

TABLE 6

| Test | 1 | 2 | 3 | 4 | 5 | 6 (gran) | 7 | 8 (gran) |
|---|---|---|---|---|---|---|---|---|
| +5M | 42.48 | 35.90 | 41.43 | 35.34 | 64.81 | 10.42 | 54.71 | 20.93 |
| −5 +6 | 12.30 | 14.22 | 6.93 | 5.27 | 7.88 | 4.70 | 11.49 | 3.77 |
| −6 +7 | 14.52 | 16.03 | 7.97 | 5.83 | 7.80 | 5.89 | 10.44 | 6.75 |
| −7 +8 | 8.45 | 10.30 | 5.27 | 6.37 | 5.13 | 6.52 | 6.86 | 9.99 |
| −8 +10 | 6.58 | 7.42 | 4.86 | 6.29 | 3.83 | 6.54 | 5.38 | 10.63 |
| −10 | 15.66 | 16.13 | 33.55 | 40.9 | 10.55 | 65.93 | 11.12 | 47.94 |
| Total Wt., g | 1607.3 | 4275.6 | 1901.6 | 559.9 | 7178.8 | 6138.0 | 2261.9 | 279.55 |
| *−5 +10 | 41.85 | 47.97 | 25.03 | 23.76 | 24.64 | 23.65 | 36.17 | 31.14 |

*Potential "product" in shotgun size range.
5M = 0.157"
6M = 0.132"
7M = 0.111"
8M = 0.0937"
10M = 0.0787

Average bulk densities for the 40% W and 46% alloys were 10.0 g/cm$^3$ and 10.22 g/cm$^3$, respectively. An actual analysis of the 46% alloy (Run 7) showed it to be 43.5% W, indicating incomplete dissolution of the W powder:

| | | | |
|---|---|---|---|
| W | 43.5% | As | 2.8 ppm |
| C | 2.5% | Sb | <1 ppm |
| Si | 3330 ppm | Bi | <1 ppm |
| Mn | 890 ppm | Pb | 13 ppm |
| P | 450 ppm | Sn | 6.1 ppm |
| S | 68 ppm | Mo | <100 ppm |
| Cu | 160 ppm | | |
| Ni | 800 ppm | | |
| Cr | 210 ppm | | |

Photomicrographs of typical pellets from two different size fractions of the 46% W alloy (Run 7) were made. Carbides were visible as are micropores formed by shrinkage during solidification.

EXAMPLE 9

Seven different experiments were conducted for each of two alloys made by blending −¼" crushed ferro-tungsten (analysis per Table IV below) and Sorel iron:

Alloy A—58 Fe 40 W 2 C

Alloy B—53.2 Fe 45 W 1.8 C

Calculations based on the 77.75% W content of ferro-tungsten established ferro/Sorel charge ratios of 1.0833 for Alloy A and 1.4038 for Alloy B.

TABLE 7

Ferro-Tungsten Analysis

| | | | |
|---|---|---|---|
| W: | 77.75% | Cu: | 620 ppm |
| Si: | 0.168% | As: | 360 ppm |
| S: | 500 ppm | Sn: | 250 ppm |
| P: | 260 ppm | Pb: | 350 ppm |
| C: | 440 ppm | Sb: | 110 ppm |
| Mn: | 0.154% | Bi: | 200 ppm |

TABLE 8

Sorel Iron Analysis

| | |
|---|---|
| C: | 4.3% |
| S: | 240 ppm, max. |
| Si: | 0.40%, max. |
| Mn: | 350 ppm, max. |
| P: | 300 ppm, max. |

For Runs 9 and 10, modified versions of Alloys A and B were made by adding 2% SiC powder to the charges. As shown in Table 9, residual metal skulls in the funnels from previous runs were used as "recycle" in certain subsequent runs.

TABLE 9

Charge Makeup

| Run | Weight, Sorel, lb. | Weight, Ferro-W, lb. | Weight, Recycle, lb. | Weight, SiC, lb | Total Weight, lb |
|---|---|---|---|---|---|
| 1 | 6.80 | 7.37 | 0 | 0 | 14.17 |
| 2 | 7.78 | 10.92 | 0 | 0 | 18.70 |
| 3 | 6.80 | 7.36 | 0 | 0 | 14.16 |
| 4 | 6.20 | 8.70 | 0 | 0 | 14.90 |
| 5 | 3.52 | 3.81 | 3.97 (Run 1) | 0 | 11.30 |

TABLE 9-continued

| Charge Makeup | | | | | |
|---|---|---|---|---|---|
| Run | Weight, Sorel, lb. | Weight, Ferro-W, lb. | Weight, Recycle, lb. | Weight, SiC, lb | Total Weight, lb |
| 6 | 6.86 | 9.62 | 0 | 0 | 16.48 |
| 7 | 5.44 | 5.89 | 0 | 0 | 11.33 |
| 8 | 3.30 | 4.63 | 3.29 (Run 6) | 0 | 11.22 |
| 9 | 4.86 | 5.26 | 0 | 0.20 | 10.32 |
| 10 | 4.44 | 6.23 | 0 | 0.21 | 10.88 |
| 11 | --- | --- | --- | --- | --- |
| 12 | --- | --- | --- | --- | --- |
| 13 | 4.58 | 4.96 | 0 | 0 | 9.54 |
| 14 | 0 | 0 | 11.11 (var. runs) | 0 | 11.11 |

Table 10 is a summary of test conditions used for the 14 casting runs. Temperatures were measured in the SiC crucible just prior to its removal from the induction furnace. Transfer times from the furnace to the elevated pouring platform were held nearly constant at approximately 30 seconds. The drilled graphite funnels were preheated and maintained at approximately 1675° F. prior to pouring by means of a large gas torch. Based upon spot measurements, melt temperature was observed to drop by approximately 125° F. during transfer to the pouring platform and by an additional 290° F. after filling the funnel. The "casting temperature" estimates presented in Table 10 were arrived at by subtracting 415° F. from the furnace temperatures.

TABLE 10

| Test Conditions | | | | | |
|---|---|---|---|---|---|
| Run | Alloy | Funnel Holes | Quench Medium | Furnace Temp, °F. | *Casting Temp, °F. |
| 1 | A | Single, 0.125" | water | 2850 | 2435 |
| 2 | B | " | water | 2868 | 2453 |
| 3 | A | " | 10% NaCl | 2930 | 2515 |
| 4 | B | " | 10% NaCl | 2879 | 2464 |
| 5 | A | " | 10% NaCl + high agit. | 2922 | 2507 |
| 6 | B | " | 10% NaCl + low agit. | 2886 | 2471 |
| 7 | A | 3 ea, 0.093" | 10% NaCl | 2873 | 2458 |
| 8 | B | " | 10% NaCl | 2910 | 2495 |
| 9 | A + 2% SiC | " | 10% NaCl | 2935 | 2520 |
| 10 | B + 2% SiC | " | 10% NaCl | --- | --- |
| 11 | A | 3 ea, 0.078" | 10% NaCl | --- | --- |
| 12 | B | " | 10% NaCl | --- | --- |
| 13 | A | 3 ea, 0.086" | 10% NaCl | 2917 | 2502 |
| 14 | B | " | 10% NaCl | 2947 | 2532 |

*Calculated (see text).

Graphite funnels were suspended above a stainless steel dumpster with a sloped bottom. In the present study, the dumpster was completely filled with water and was positioned to allow shot to free-fall 86" in air into 26" of water depth (as opposed to the 14" depth of the previous studies, which was found to be inadequate).

Product from the 14 runs was screened on 5-, 6-, 7-, 8-and 10-mesh screens to determine size distributions. Samples of the 56 fractions in the −5M/+10M range were mounted and polished for metallographic examination.

RESULTS

Figure 4:
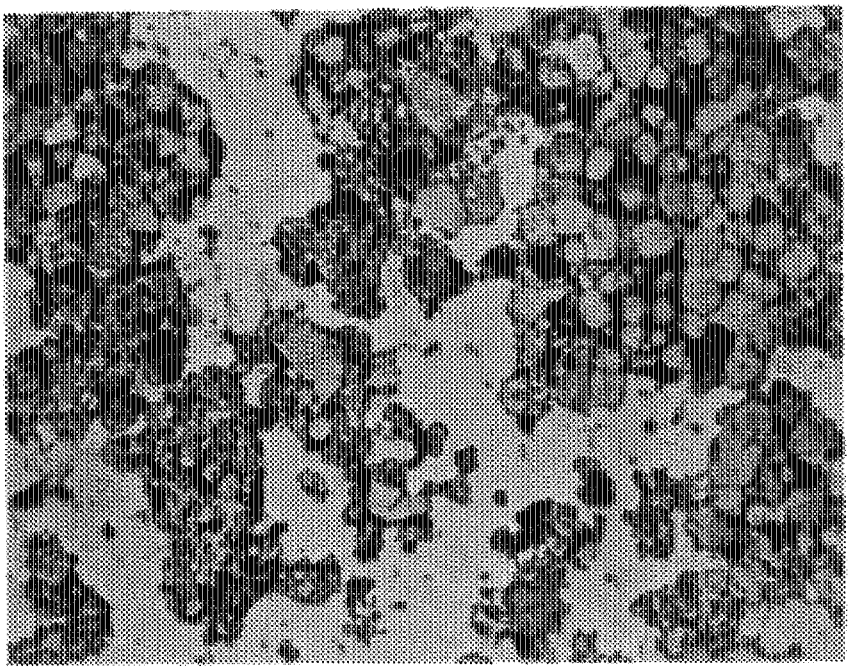
FIG. 4 is a photomicrograph of one embodiment of the present invention.

Table 11 and FIGS. 4 and 5 present particle size distributions of the 14 runs. FIG. 6 illustrates the influence of funnel orifice diameter on the percentage of potential product, i.e., particle size/distributions between 5-mesh (0.157") and 10-mesh (0.065"). An important factor to consider is that coarse (+5 mesh) particles were observed to form only from cold, viscous droplets obtained as the last metal exited the graphite funnel. These droplets do not shatter upon impact with the quenchant. The important point to note is that this scenario would not occur in a continuous operation where temperatures would be controlled under "steady state" conditions.

TABLE 11

| Shot Size Distributions | | | | | | | | | | |
|---|---|---|---|---|---|---|---|---|---|---|
| | | | | Weight Percentages | | | | | | |
| Tst | Alloy | Conditions | Total Wt., g | +5 | −5 +6 | −6 +7 | −7 +8 | −8 +10 | −10 | *−5 +10 |
| 1 | A | water, 0.125" dia. | 3145 | 57.85 | 9.91 | 11.41 | 7.14 | 4.78 | 8.88 | 33.24 |
| 2 | B | " | 2381 | 58.44 | 9.88 | 11.11 | 6.86 | 4.67 | 9.04 | 32.52 |
| 3 | A | brine, 0.125" dia. | 6126 | 50.72 | 12.29 | 12.46 | 8.26 | 5.58 | 10.69 | 38.59 |
| 4 | B | " | 4239 | 48.1 | 12.72 | 13.44 | 8.32 | 5.99 | 11.42 | 40.47 |

TABLE 11-continued

Shot Size Distributions

| Tst | Alloy | Conditions | Total Wt., g | Weight Percentages +5 | −5 +6 | −6 +7 | −7 +8 | −8 +10 | −10 | *−5 +10 |
|---|---|---|---|---|---|---|---|---|---|---|
| 5 | A | agit. brine, 0.125" dia. | 3894 | 44.06 | 13.41 | 14.15 | 8.85 | 6.6 | 12.93 | 43.01 |
| 6 | B | " | 4050 | 42.86 | 13.86 | 14.0 | 9.15 | 6.94 | 13.21 | 43.95 |
| 7 | A | brine, 0.093" dia. | 5695 | 46.6 | 13.64 | 13.27 | 8.44 | 6.05 | 12.0 | 41.4 |
| 8 | B | " | 2429 | 38.97 | 14.33 | 15.15 | 9.68 | 7.14 | 14.74 | 46.3 |
| 9 | A + SiC | " | 4500 | 33.63 | 15.52 | 16.42 | 12.35 | 8.39 | 13.69 | 52.68 |
| 10 | B + SiC | " | 2763 | 32.46 | 17.34 | 16.72 | 11.09 | 8.26 | 14.13 | 53.41 |
| 11 | A | brine, 0.078" dia. | 3587 | 28.86 | 18.69 | 18.77 | 11.15 | 8.15 | 14.39 | 56.76 |
| 12 | B | " | 1242 | 30.28 | 16.28 | 17.69 | 11.2 | 8.08 | 16.48 | 53.25 |
| 13 | A | brine, 0.086" dia. | 4890 | 42.87 | 14.66 | 14.83 | 9.38 | 6.75 | 11.52 | 45.62 |
| 14 | B | " | 2200 | 37.11 | 15.33 | 16.76 | 10.68 | 7.49 | 12.65 | 50.26 |

*Potential product size range.

Average bulk densities for the −6M/+7M fractions were determined by water displacement as presented in Table 12. Values in parentheses were additionally obtained by diameter measurements of ten pellets per sample.

TABLE 12

Pellet Densities (−6M/+7M)

| Run | 1 | 2 | 3 | 4 | 5 | 6 | 7 | 8 | 9 | 10 | 11 | 12 | 13 | 14 |
|---|---|---|---|---|---|---|---|---|---|---|---|---|---|---|
| Wt, g | 10.08 | 10.58 | 8.39 | 14.74 | 9.68 | 10.87 | 10.35 | 10.25 | 9.91 | 11.56 | 10.02 | 9.90 | 9.23 | 10.70 |
| Vol. $cm^3$ | 1.1 | 1.1 | 0.9 | 1.4 | 1.0 | 1.1 | 1.0 | 1.0 | 1.0 | 1.1 | 1.0 | 1.1 | 0.9 | 1.0 |
| ρ $g/cm^3$ | (10.3) 9.2 | (10.6) 9.6 | (10.5) 9.3 | 10.5 | 9.7 | 9.9 | 10.4 | 10.3 | 9.9 | 10.5 | 10.0 | 9.0 | 10.3 | 10.7 |

Bulk samples and metallographic mounts of all 56 size fractions between 5- and 10-mesh were examined by the inventor whose qualitative comments appear in Table 13.

TABLE 13

Particle Shape and Integrity (−5M/+10M)

| Run | Shape Description | Internal Integrity |
|---|---|---|
| 1 | generally spherical | some porosity, no cracks |
| 2 | generally spherical | some porosity, no cracks |
| 3 | generally spherical | some porosity, many cracks |
| 4 | generally spherical | some porosity, many cracks |
| 5 | many flattened pieces | some porosity, many cracks |
| 6 | many flattened pieces | some porosity, many cracks |
| 7 | generally spherical | some porosity, many cracks |
| 8 | generally spherical | some porosity, many cracks |
| 9 | many broken pieces, some flattened | some porosity, many cracks |
| 10 | generally spherical | some porosity, many cracks |
| 11 | generally spherical | some porosity, many cracks |
| 12 | generally spherical | some porosity, many cracks |
| 13 | generally spherical | some porosity, many cracks |
| 14 | generally spherical | some porosity, many cracks |

In comparison with the earlier experiments, far fewer agglomerated ("twins", "moon-planet", etc.) particles were observed. This was probably due to the fact that increased water depth was used in the present studies. Another qualitative observation is that larger spheres tend to be higher in porosity, some even appearing as hollow shells. We again attribute this to cold, viscous droplets near the end of a run which would not be encountered in a controlled, continuous operation.

Discussion of Results

A summary of the inventors' observations and opinions include:

1. Brine quenching in 10% NaCl, while having a beneficial effect on particle size, results in cooling rates so fast as to cause cracking within the parties.
2. Molten stream size, as determined by funnel orifice diameter, has a significant influence on particle size distribution. Smaller orifices tend to produce a higher percentage of desirable (for shotgun applications) sizes.
3. Quenchant agitation causes non-spherical particles to form during solidification.
4. Eliminating coarse (+5 mesh) particles by controlling temperature (and related viscosity) in a continuous process should place 75–85% of the product within the desired size range.
5. Particle shape and density must be addressed before declaring any particles to be final product.
6. Addition of 2% SiC to either alloy (A or B) produced visually fluid melts, but these alloys were quite brittle.
7. The 40% W and 45% W alloys did not appear to behave in significantly different ways. It is contemplated that it is possible to further increase W concentration (in order to increase density) and still retain castability at tolerable temperatures.
8. Ferro-tungsten is readily alloyed with Sorel iron.

These experiments appear to indicate that a scaled-up production process will be feasible. One skilled in this art would envision a continuous melting process in which two relatively small (e.g., 500 lb) induction furnaces supply a constant flow of molten alloy to a tundish equipped with ceramic orifices. Product would be easily removed from the quench tank by magnetic methods, followed by screening and shape/density separation methods commonly used by mineral and metallic shot industries. Acceptable product would be bled off, heat-treated and optionally final-ground. All non-product would be recycled back to the melting process.

A high recycle load to the melting process (e.g., 75%) should be tolerable.

In subsequent experiments, the inventor has explored the use of a slow quenching medium (0.05–0.10% polyvinyl alcohol in water), smaller funnel orifice diameter (0.078", 0.062" and 0.050"), and "high" (84") versus "low" (24") free-fall distances, with favorable results to those described herein.

The following Table 14 illustrates the effects of these variables on FeW particle-size distribution. Product evaluations are presently incomplete, but here are some preliminary observations.

The latest experiments were successfully performed using an alloy containing 46.2% W. This alloy was at 2953° F., as opposed to 2900° F. used for melting 45% W alloy. Calculated carbon content for this alloy is 1.72%. Melt fluidity was not noticeably lower in this alloy. The available ternary phase diagrams indicate that increasing carbon up to around 3.0–3.5% may allow casting of alloys containing perhaps as much as 60–65% W at temperatures of 1500°–1550° C.

The invention described herein can be practiced in a wide variety of ways utilizing tungsten, iron or copper, or zinc or aluminum or other suitable metal as either the primary or secondary metal to be utilized with tungsten. It will be appreciated that the steps employed together with the materials and conditions used in the sintering process can also be varied, depending on the projected properties, desired such as density and strength. For example, it has been demonstrated that smaller median particle size will increase density. Likewise, different temperature regions will produce different properties as described herein. Likewise, the selection of different quench media and sieve size and height can be varied as well as composition ranges including additions such as carbon to enhance desired particle size distributions from various temperatures of the molten material.

TABLE 14

SIZE DISTRIBUTIONS

| TEST | % W | **CONDITIONS | TOTAL WT, g | WEIGHT PERCENTAGES +5 | −5 +6 | −6 +7 | −7 +8 | −8 +10 | −10 | *−5 +10 |
|---|---|---|---|---|---|---|---|---|---|---|
| M1 | 45 | 0.078, hi, 0.05 PVA | 496.6 | 6.0 | 13.9 | 27.8 | 22.3 | 11.3 | 18.7 | 75.3 |
| M2 | 45 | 0.062, hi, 0.05 PVA | 1143.2 | 21.6 | 19.3 | 25.4 | 12.3 | 7.7 | 13.7 | 64.7 |
| M3 | 45 | 0.050, hi, 0.05 PVA | 402.7 | 11.9 | 7.5 | 18.7 | 21.9 | 14.9 | 25.1 | 63.0 |
| M4 | 45 | 0.078, low, 0.05 PVA | 1070.9 | 67.5 | 16.1 | 10.6 | 2.6 | 1.3 | 1.9 | 32.5 |
| M5 | 45 | 0.062, low, 0.05 PVA | 1852.8 | 33.0 | 30.6 | 24.5 | 9.3 | 1.2 | 1.4 | 65.6 |
| +M6 | 45 | 0.050, low, 0.05 PVA | 52.4 | 9.7 | 15.9 | 28.4 | 21.1 | 16.3 | 8.6 | 81.7 |
| M7 | 45 | 0.078, low, 0.1 PVA | 529.1 | 75.3 | 14.2 | 6.4 | 1.9 | 1.0 | 1.2 | 23.5 |
| M8 | 45 | 0.062, low, 0.1 PVA | 1237.9 | 53.1 | 22.6 | 17.8 | 4.0 | 1.2 | 1.3 | 45.6 |
| +M9 | 45 | 0.078, hi, 0.1 PVA | 47.6 | 3.7 | 14.4 | 24.5 | 22.4 | 13.4 | 21.6 | 74.7 |
| +M10 | 45 | 0.062 hi, 0.1 PVA | 111.5 | 43.7 | 16.9 | 14.2 | 8.0 | 6.9 | 10.3 | 46.0 |
| M11 | 46.2 | 0.078, hi, 0.1 PVA | 2825.2 | 10.1 | 16.4 | 26.1 | 17.0 | 10.9 | 19.5 | 70.4 |

*Shotgun-size "product": 5M (0.157")–10M (0.078")
+ Insufficient sample size/low reliability
**"Conditions" refer to funnel orifice dia., free-fall distance, PVA concentration When compared against results of the previous experiments, slow quenching with PVA produced shot with markedly improved sphericity.

PVA quenching also resulted in finer particle size distributions than were obtained with, for example, fast brine quenching, all other known variables (e.g., melt temperature, orifice size, free-fall distance) being held constant. Product (−5M/+10M) yields with PVA quenching exceeded 70%, compared with ≦57% for brine quenching.

Free-fall distance (from bottom of sieve to quench liquid surface) has a significant effect on particle size distribution, a large drop resulting in increased shattering of the molten droplets upon impact and, therefore, a finer particle size distribution.

The following generalizations based on the data are believed to be valid.

Particle size distribution may be effectively controlled by varying funnel orifice size and, independently, by varying free-fall distance. In all experiments to date, a relatively wide spectra of sizes were obtained.

Particle shape (i.e., "sphericity") is strongly influenced by quench medium. This is primarily a function of the different cooling rates obtained during solidification determined by the various thicknesses of vapor blankets surrounding the particles.

The invention is therefore only to be limited to the scope of the claims interpreted in view of the applicable prior art.

What is claimed is:

1. A process for making high specific gravity essentially spherical non-toxic, lead free solid shotshell pellets consisting essentially of an alloy of iron and from about 30% to 46% by weight tungsten which comprises the steps of:

a) preparing an alloy consisting essentially of from about 30% to about 46% by weight of Tungsten and about 55% to about 70% iron having a calculated specific gravity in the range of from about 8 to about 10.5 g/cm$^3$;

b) melting said alloy at about 1645° C. to about 1760°;

c) pouring said molten alloy at a temperature above about 1550° C. through at least one orifice of a sieve orifice opening sized to produce a specific shot pellet size and allowing the sieved alloy to fall by gravity through a gas to form drops which individually fall into a liquid forming a multiplicity of spheres from each drop, and then permitting said spheres to cool; and d) recovering the cooled spheres of alloy shot.

2. The process of claim 1 in which the pellet spheres are classified into a plurality of sizes.

3. The process of claim 1 in which the gas is air and the liquid is water, both at ambient temperature.

4. A process for making high specific gravity, essentially spherical, non-toxic, lead free, solid, pellet shot projectiles consisting essentially of an alloy of between about 30% to 65% by weight of tungsten, from between about 70% to about 35% by weight of iron and up to about 3.5% by weight of carbon, comprising the steps of:

a) preparing a melt consisting essentially of tungsten and iron in proportions selected to impart a specific gravity to the finished product above about 8 grams per cubic centimeter and below the specific gravity of tungsten and a minor amount of carbon in an amount sufficient to promote the shattering of drops of the melt when initially quenched in a liquid;

b) maintaining said melt at a temperature of from about 1550° C. to about 1760° C., said temperature being selected to provide a sufficiently low melt viscosity to enable the melt to subsequently be poured through an orifice which is sized to produce a distribution of shot pellet sizes;

c) pouring said melt through at least one orifice sized to form a stream of molten metal alloy from the melt, d) permitting the stream of molten metal to fall by gravity through a gaseous media for a sufficient distance to form discrete separate drops or globules of falling molten metal;

e) quenching the metal in a liquid medium under conditions which promote the shattering of the drops into smaller drops which then form on cooling and solidifying in the quench medium into solid spherical metal pellets having said distribution of shot pellet sizes and;

f) recovering the solid spherical metal pellets from the liquid quench medium.

5. The method of claim 4 wherein the quench medium is water or water with up to about 10% by weight added soluble salt, or water containing 0.05% to about 0.10% of a water soluble vinyl polymer.

6. The method of claim 4 wherein the gaseous media selected is air.

7. The method of claim 4 wherein the quench medium is water containing about 0.05% to about 0.10% polyvinylalcohol.

8. The method of claim 7 wherein the carbon content of the melt is from about 3.0% to about 3.5% by weight.

9. The method of claim 8 wherein the gaseous media selected is air.

10. The method of claim 6 wherein the composition of the melt consists essentially of from about 30% to about 46% by weight of tungsten and about 55% to about 70% by weight of iron and optionally up to about 3.5% carbon.

* * * * *